US008823276B2

(12) United States Patent
Cho et al.

(10) Patent No.: US 8,823,276 B2
(45) Date of Patent: Sep. 2, 2014

(54) LIGHT UNIT AND DRIVING METHOD THEREOF

(75) Inventors: Ju-Sung Cho, Asan-si (KR); Song-Yi Han, Asan-si (KR); Kyun-Ho Kim, Daejeon (KR); Seung-Young Choi, Seoul (KR)

(73) Assignee: Samsung Display Co., Ltd. (KR)

( * ) Notice: Subject to any disclaimer, the term of this patent is extended or adjusted under 35 U.S.C. 154(b) by 244 days.

(21) Appl. No.: 13/346,050

(22) Filed: Jan. 9, 2012

(65) Prior Publication Data

US 2013/0038232 A1 Feb. 14, 2013

(30) Foreign Application Priority Data

Aug. 10, 2011 (KR) ..... 10-2011-0079620

(51) Int. Cl.

| | |
|---|---|
| ***H05B 37/02*** | (2006.01) |
| ***G09G 3/34*** | (2006.01) |
| *G09G 3/00* | (2006.01) |

(52) U.S. Cl.

CPC ..... *G09G 3/3406* (2013.01); *G09G 2330/04* (2013.01); *G09G 3/006* (2013.01); *G09G 2330/02* (2013.01)

USPC ..... 315/224

(58) Field of Classification Search

USPC ..... 315/291, 297, 307, 246, 247, 224, 315/209 R, 276, 277, 278

See application file for complete search history.

(56) References Cited

U.S. PATENT DOCUMENTS

| | | | | |
|---|---|---|---|---|
| 7,839,376 | B2 | 11/2010 | Shin et al. | |
| 7,869,227 | B2 * | 1/2011 | Lee et al. | 363/20 |
| 2007/0298662 | A1 * | 12/2007 | Kim | 439/620.02 |
| 2010/0060191 | A1 * | 3/2010 | Ashikaga et al. | 315/291 |
| 2010/0253243 | A1 * | 10/2010 | Kim et al. | 315/294 |
| 2010/0321369 | A1 * | 12/2010 | Cho | 345/211 |

FOREIGN PATENT DOCUMENTS

| | | |
|---|---|---|
| JP | 2990160 | 10/1999 |
| JP | 2001222347 | 8/2001 |
| JP | 2002268608 | 9/2002 |
| JP | 2002311905 | 10/2002 |
| JP | 3616247 | 11/2004 |
| JP | 4484006 | 4/2010 |
| KR | 100214517 | 5/1999 |
| KR | 100250656 | 1/2000 |
| KR | 1020050034259 | 4/2005 |
| KR | 100593760 | 6/2006 |
| KR | 100674873 | 1/2007 |
| KR | 1020090090933 | 8/2009 |
| KR | 100975279 | 8/2010 |

* cited by examiner

*Primary Examiner* — Minh D A

(74) *Attorney, Agent, or Firm* — Cantor Colburn LLP

(57) ABSTRACT

A light unit includes: an integrated power ("IP") board which receives power supply and converts the power supply into a high voltage and a supply voltage; a lamp; and a terminal board ("T board") which receives the high voltage from the IP board to turn on the lamp, receives the supply voltage from the IP board to transfer the supply voltage to the IP board, in which the IP board transfers the high voltage to the T board after the IP board receives the supply voltage from the T board.

18 Claims, 9 Drawing Sheets

LIGHT UNIT AND DRIVING METHOD THEREOF

This application claims priority to Korean Patent Application No. 10-2011-0079620, filed on Aug. 10, 2011, and all the benefits accruing therefrom under 35 U.S.C. §119, the content of which in its entirety is herein incorporated by reference.

BACKGROUND OF THE INVENTION (a) Field of the Invention

Exemplary embodiments of the invention relate to a light unit and a driving method of the light unit, and include a backlight unit for a liquid crystal display and a driving method of the backlight unit.

(b) Description of the Related Art

Recently, the demand for a flat panel display with improved performance and with reduced size and weight has been substantially increased.

A liquid crystal display ("LCD"), which is one of the most widely used types of the flat panel display, has characteristics such as small size, light weight and low power consumption, for example. Accordingly, the LCD is typically used for information processing devices including a display part.

In general, the LCD applies different potentials to a pixel electrode and a common electrode while injecting a liquid crystal material between an upper substrate including the common electrode and a color filter, and a lower substrate including a thin film transistor and the pixel electrode. Accordingly, the LCD generates electric fields and changes alignment of liquid crystal molecules to control transmittance of light, thereby displaying images.

A liquid crystal panel of the LCD is a light receiving element which is not self-emitted, such that a backlight unit for supplying the light to the liquid crystal panel is provided below the liquid crystal panel. The backlight unit includes a lamp, a light guide plate, a reflective sheet and optical sheets, for example. The lamp generates white light having relative small heat value and being close to natural light and uses a cold cathode ray tube type lamp having long lifespan or a light emitting diode ("LED") type lamp using the LED having improved color reproducibility and low power consumption.

In the case of the LED type lamp and the cold cathode ray tube type lamp, the lamp is turned on by high voltage, and the high voltage applied to the lamp is generated from a separate board to be transferred to the lamp. In the LED type lamp and the cold cathode ray tube type lamp, a worker may fasten the connector for connecting the board and the lamp to complete the light unit, and the worker may have an electric shock by high voltage flow during the connection process.

BRIEF SUMMARY OF THE INVENTION

Exemplary embodiments of the invention provide a light unit that effectively prevents a worker from having an electric shock due to high voltage in a fastening process of a connector, and a driving method of the light unit.

An exemplary embodiment of the invention provides a light unit including: an integrated power ("IP") board which receives power supply and converts the power supply into a high voltage and a supply voltage; a lamp; and a terminal board ("T board") which receives the high voltage from the IP board to turn on the lamp, receives the supply voltage from the IP board to transfer the supply voltage to the IP board, in which the IP board transfers the high voltage to the T board after the IP board receives the supply voltage from the T board.

In an exemplary embodiment, the IP board and the T board may be connected to each other by a connector.

In an exemplary embodiment, the IP board may include a power-factor-correction ("PFC") converter which generates the supply voltage and the high voltage based on a voltage of the power supply; and an inverter integrated circuit ("IC)" which transmits and receives the supply voltage to and from the T board, and transfers the high voltage to the T board.

In an exemplary embodiment, the T board may include a first pad which receives the supply voltage, and a second pad which transfers the supply voltage to the IP board.

In an exemplary embodiment, the T board may further include a third pad and a fourth pad which receive the high voltage, a fifth pad which receives ground voltage, and a sixth pad and a seventh pad which receive a signal for verifying a state of the lamp.

In an exemplary embodiment, the inverter IC may include a transistor, and the inverter IC may transfer the high voltage to the T board after a predetermined time lapses from a time when the transistor is turned on by the supply voltage transferred from the second pad of the T board.

In an exemplary embodiment, the predetermined time may be in a range form about 0.5 second to about 6 seconds.

In an exemplary embodiment, the predetermined time may be in a range from about 1.5 seconds to about 1.6 seconds.

In an exemplary embodiment, the light unit may further include at least one of an image board and a timing controller ("T-con") board, and the light unit may be a backlight unit for a liquid crystal display.

Another exemplary embodiment of the invention provides a driving method of a light unit, including: applying a supply voltage from an IP board to a T board; transferring the supply voltage from the T board to the IP board; applying a high voltage to the T board after a predetermined time elapses from a time when the IP board receives the supply voltage; and turning on a lamp using the high voltage from the T board.

In an exemplary embodiment, the applying the supply voltage from an IP board to a T board may include applying the supply voltage from the IP board to the T board via a connector connected to the IP board and the T board.

In an exemplary embodiment, the transferring the supply voltage from the T board to the IP board may include transferring the supply voltage from the T board to the IP board via a loop circuit.

In an exemplary embodiment, the IP board may include a PFC converter which generates the supply voltage and the high voltage based on a voltage of power supply inputted thereto; and an inverter IC which transmits and receives the supply voltage to and from the T board and transfers the high voltage to the T board.

In an exemplary embodiment, the T board may include a first pad which receives the supply voltage and a second pad which transfers the supply voltage to the IP board.

In an exemplary embodiment, the inverter IC may include a transistor, and the inverter IC may transfer the high voltage to the T board after a predetermined time lapses from a time when the transistor is turned on by the supply voltage transferred from the second pad of the T board.

In an exemplary embodiment, the light unit may further include at least one of an image board and a T-con board, and the light unit may be a backlight unit for a liquid crystal display.

According to exemplary embodiments of the invention, application of the high voltage to the lamp is delayed for a predetermined time, and the risk of electric shock by the high voltage in a fastening process of the connector by a worker is thereby substantially reduce.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION OF THE INVENTION

Figure 1:
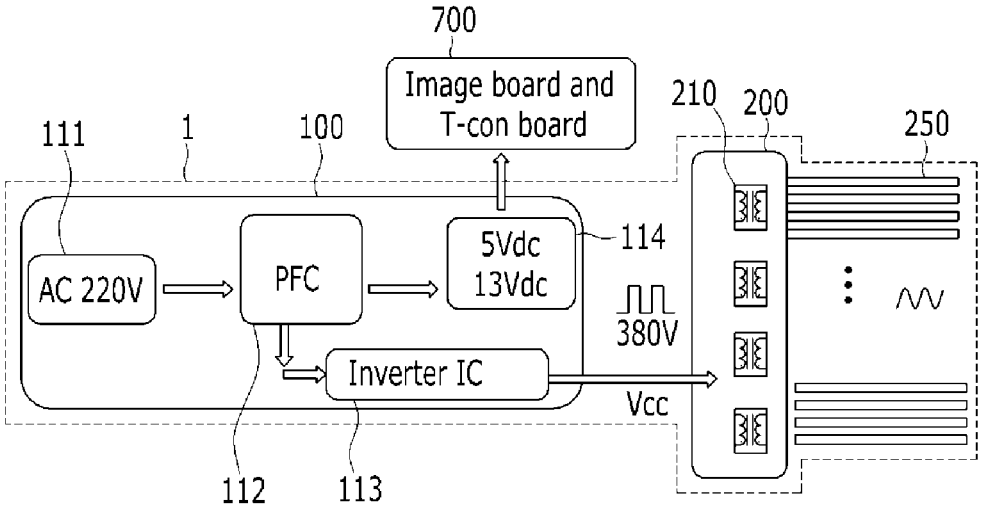
FIG. 1 is a block diagram showing an exemplary embodiment of a light unit according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in further detail with reference to the accompanying drawings.

First, an exemplary embodiment of the light unit will be described with reference to FIG. 1.

FIG. 1 is a block diagram showing an exemplary embodiment of a light unit according to the invention.

A light unit 1 includes an integrated power ("IP") board 100, a terminal board ("T board") 200 and a lamp 250.

The IP board 100 converts a power supply inputted from outside and transfers the power supply to the T board 200. In an exemplary embodiment, the IP board 100 is a type of switching mode power supply ("SMPS"). The IP board 100 includes a power-factor-correction ("PFC") converter 112, an inverter integrated circuit ("IC") 113, a receiving part 111 and an output part 114. The receiving part 111 receives the power supply. In an exemplary embodiment, the receiving part 111 receives alternating current ("AC") voltage of about 220 volts (V), and the AC voltage of about 220 V is transferred to the PFC converter 112 to be converted into a voltage for the light unit 1. In an exemplary embodiment, the PFC converter 112 may generate a power supply voltage for the light unit 1 and a part connected to the light unit 1. In an exemplary embodiment, where the light unit 1 is a backlight unit for a liquid crystal display, the PFC converter 112 generates power supply voltages used in other boards, e.g., an image board and a timing controller ("T-con") board 700 that may be provided in the liquid crystal display, as shown in FIG. 1. Hereinafter, the backlight unit will be described in greater detail.

In an exemplary embodiment, the PFC converter 112 generates an AC voltage of 380 V to be used in the T board 200, a supply voltage Vcc and direct current ("DC") voltages of about 5 V and about 13 V to be used in the image board and the T-con board 700 based on the power supply, e.g., the AC voltage of about 220 V. In an exemplary embodiment, the PFC converter 112 may include a transformer (not shown) for transforming voltages.

In an exemplary embodiment, the PFC converter 112 transfers the AC voltage of about 380 V and the supply voltage Vcc to the inverter IC 113, and transfers the DC voltages of about 5 V and about 13 V to the image board and the T-con board 700.

The image board and the T-con board 700, which receive the DC voltages of about 5 V and about 13 V, may perform an image processing procedure.

In an exemplary embodiment, the inverter IC 113 receives the AC voltage of about 380 V (hereinafter, also referred to as "high voltage") and the supply voltage Vcc, and transfers the high voltage of about 380 V and the supply voltage Vcc to the T board 200, after a procedure for verifying whether the high voltage is allowed to be transferred to the T board 200. An exemplary embodiment of the procedure will be described later in detail with reference to FIGS. 4 to 6. The supply voltage Vcc is a DC voltage in a range from about 10 V to about 12 V, and the high voltage of about 380 V may in form of a switching square wave signal, as shown in FIG. 1.

The T board 200 receives the AC voltage of 380 V, controls the AC voltage of 380 V using the transformer 210 and then, transfers the controlled voltage to the lamp 250. In an exemplary embodiment, the T board 200 may further include a balance unit which allows the lamp 250 to emit light with uniform luminance within a predetermined range.

In an exemplary embodiment, the lamp 250 may be a fluorescent lamp of a cold cathode ray tube lamp, e.g., a cold cathode fluorescent lamp ("CCFL"), or a light emitting diode ("LED") lamp.

Hereinafter, an exemplary embodiment of the T board will be described in detail.

Figure 2:
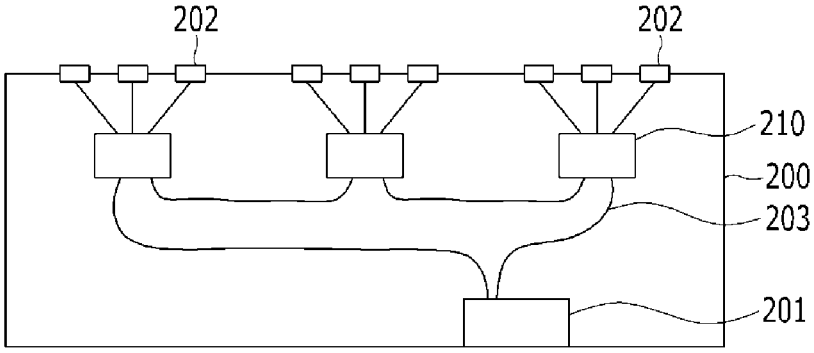
FIGS. 2 and 3 are plan views of an exemplary embodiment of a terminal board ("T board") connected to a connector according to the invention.
Figure 3:
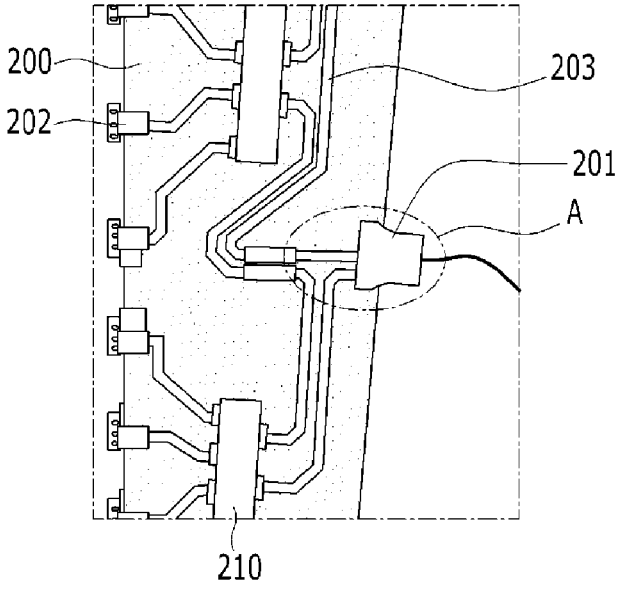

FIGS. 2 and 3 are plan views of an exemplary embodiment of the T board connected to a connector according to the invention.

An exemplary embodiment of the T board 200 has a plurality of transformers 210, and each of the transformers 210 has a plurality of output terminals 202. The lamp 250 may be connected to each output terminal 202. In an exemplary embodiment, the lamp 250 may includes two ends, e.g., a first end of the lamp 250 connected to one of the output terminals 202 and a second end which is grounded. In such an embodiment, where the second end of the lamp 250 is grounded, a length of a wiring may be substantially reduced and an overall size of the light unit 1 may be substantially slim.

FIG. 2 schematically shows an overall structure of the T board 200, and the inputted AC voltage of about 380 V may be transferred to the output terminal 202 connected with the lamp 250 via the transformer 210 through a power supply wiring 203. The power supply wiring 203 of FIG. 2 receives the AC voltage of about 380 V through a connector 201. The connector 201 and an input and output pad part 220 of the T board 200 (shown in FIG. 4) transfer various signals, and signals in the input and output pad part 220 will be described later in detail referring to FIG. 4.

FIG. 3 shows a portion of an exemplary embodiment of the T board 200 according to the invention. In an exemplary embodiment, the power supply wiring 203 connected with the connector 201 may have a wide width for transferring the high voltage.

In an exemplary embodiment, as shown in the portion A of FIG. 3, the connector 201 may be fastened to the T board 200. In such an embodiment, the connector is fastened directly by a worker such that the worker may have an electric shock due to the high voltage while fastening the connector 201. In an exemplary embodiment, the high voltage is not applied and the high voltage is applied after a predetermined time elapses and the worker fastens the connecter 201 during the predetermined time such that the worker may work without the risk of electric shock.

Hereinafter, a structure of an exemplary embodiment of the input and output pad part 220 will be described in detail with reference to FIG. 4.

Figure 4:
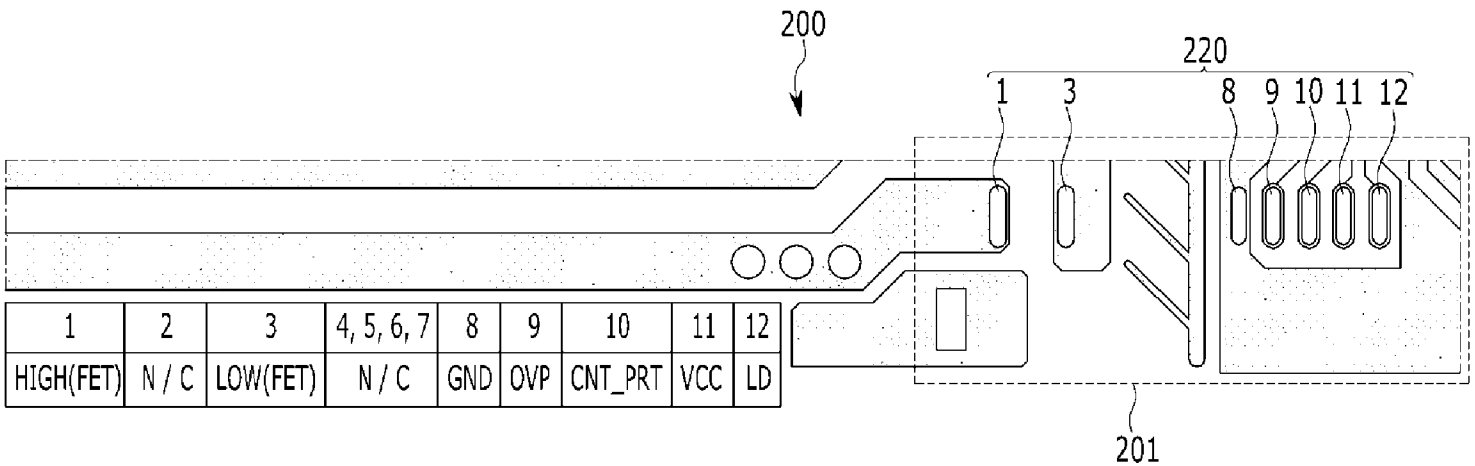
FIG. 4 is a plan view of an input and output pad of an exemplary embodiment of the T board according to the invention.

FIG. 4 is a plan view of an input and output pad of an exemplary embodiment of a T board according to the invention.

An exemplary embodiment of the input and output pad part 220 of the T board 200 includes seven pads, e.g., a first pad 11, a second pad 10, a third pad 1, a fourth pad 3, a fifth pad 8, a sixth pad 9 and a seventh pad 12. In FIG. 4, the numbers of the pads correspond to the numbers of twelve connection terminals of the connector 201, and pads are not provided at the connection terminals corresponding to numbers 2, 4, 5, 6 and 7 such that signals are not transmitted through the connection terminals corresponding to the numbers 2, 4, 5, 6 and 7.

First, the third and fourth pads 1 and 3 are pads where the high voltage of about 380 V transferred from the IP board 100 is transferred and denoted as "HIGH (FET)" and "LOW (FET)" in FIG. 4. The high voltage may be inputted through the third pad 1 and may be outputted through the fourth pad 3.

A ground voltage GND is applied to the fifth pad 8 (also referred to as "GND pad") and the fifth pad 8 is denoted as GND in FIG. 4. In an exemplary embodiment, an over voltage protection ("OVP") signal is applied to the sixth pad 9 (also referred to as "OVP pad") and the sixth pad 9 is denoted as OVP in FIG. 4 and a lamp detect ("LD") signal is applied to the seventh pad 12 (also referred to as "LD pad") and pad 12 is denoted as LD in FIG. 4. The OVP signal and the LD signal are signals for checking whether or not an error exists in the lamp 250. The OVP signal checks whether a voltage change does not exist by connecting the adjacent lamps 250 in a zigzag form, and the LD signal checks the state of the lamp 250. If the error of the lamp 250 is detected from the fifth and seventh pads 8 and 12, the detected error state may be transferred from the IP board 100 to the T-con board 700.

The first pad 11 (also referred to as "VCC pad") transfers a constant voltage, e.g., the supply voltage Vcc, which may be about 12 V in an exemplary embodiment, and is denoted as VCC in FIG. 4, and the second pad 10 (also referred to as "CNT_PRT pad") is a pad, where the supply voltage Vcc inputted to the first pad 11 is outputted, and is denoted as CNT_PRT in FIG. 4. In an exemplary embodiment, when the supply voltage Vcc inputted to the first pad 11 is outputted through the second pad 10, it is verified that the connector 201 is completely connected. In an exemplary embodiment, although the supply voltage Vcc is applied to a portion connected with the first pad 11 and a separate signal is not received at a portion connected with the second pad 10 in the connector 201, it may be detected that the connector 201 is fastened when the supply voltage Vcc of about 12 V is inputted through the second pad 10 via fastened connector 201.

Hereinafter, a moving path of the supply voltage Vcc in an exemplary embodiment of the T board will be described with reference to FIG. 5.

Figure 5:
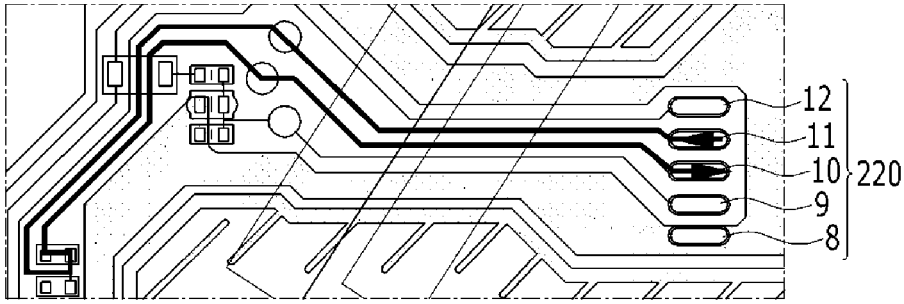
FIG. 5 is a plan view of an exemplary embodiment of a T board showing a signal moving path therein before high voltage is applied according to the invention.

FIG. 5 is a plan view of an exemplary embodiment of a T board showing a signal moving path before high voltage is applied according to the invention.

A porting of an exemplary embodiment of the T board 200 is shown in FIG. 5 and a wiring extending from the first pad 11 is connected with the second pad 10 to thereby define a loop circuit. In an exemplary embodiment, the loop circuit includes only one resistor. An arrow shown in FIG. 5 indicates the moving path of the supply voltage Vcc (see FIG. 7A).

In such an embodiment, when the supply voltage Vcc is transferred to the IP board 100 through the connector 201, the IP board 100 allows the high voltage of about 380 V to be applied to the T board 200. In an exemplary embodiment, the high voltage is not applied to the T board 200 after the supply voltage Vcc is received from the T board 200, and the high voltage of about 380 V may be applied to the T board 200 after a predetermined time (for example, about 1.5 to about 1.6 seconds) is delayed.

Hereinafter, a transfer order of the high voltage in an exemplary embodiment of the T board and the IP board according to the invention will be described.

Figure 6:
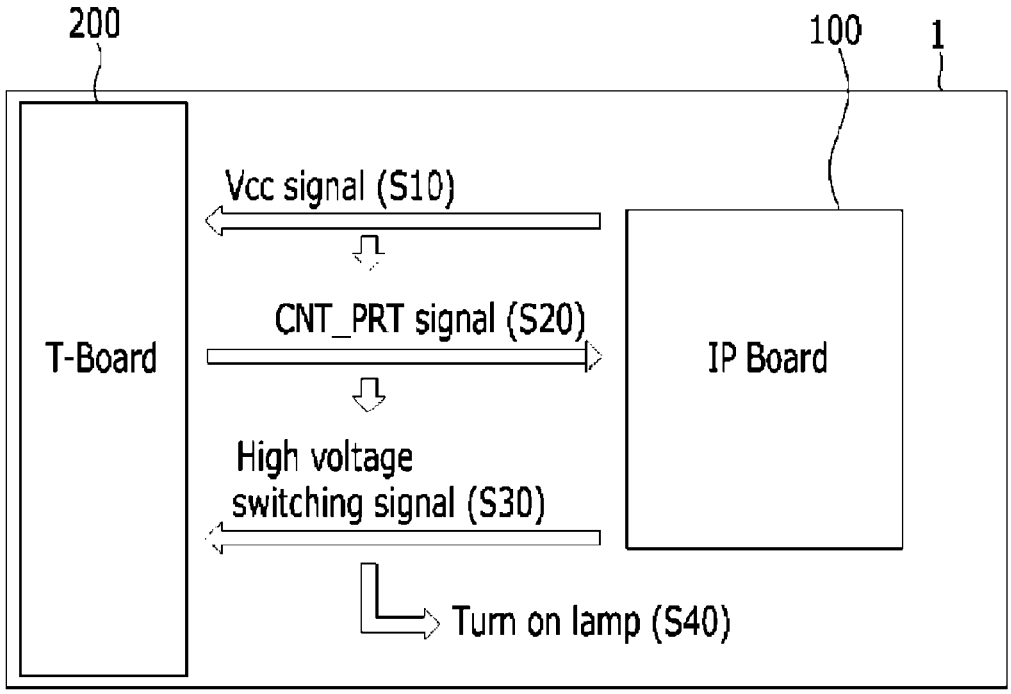
FIG. 6 is a block diagram showing signals between an exemplary embodiment of a T board and an integrated power ("IP") board according to the invention.

FIG. 6 is a block diagram showing signals between an exemplary embodiment of a T board and an IP board according to the invention.

FIG. 6 shows the IP board 100 and the T board 200, and a process for determining when to transfer the high voltage to the T board 200.

In an exemplary embodiment, where the IP board 100 and the T board 200 are connected by the connector 201, the supply voltage Vcc is applied from the connector 201 to the first pad 11 (VCC) of the T board 200 (S10).

The supply voltage Vcc applied to pad 11 VCC of the T board 200 passes the loop circuit in the T board 200 to be transferred to the second pad 10 (CNT_PRT) and the supply voltage Vcc is transferred to the IP board 100 through a terminal of the connector 201 contacting the second pad 10 (CNT_PRT) (S20).

The IP board 100 receives the supply voltage Vcc and applies the high voltage to the T board 200 after a predetermined time, e.g., about 1.5 seconds to about 1.6 seconds, elapses (S30). In an exemplary embodiment of the invention, the inverter IC 113 of the IP board 100 applies the high voltage to the T board 200 after receiving the supply voltage Vcc and delaying the supply voltage Vcc for a predetermined time. A structure of an exemplary embodiment of the inverter IC 113 will be described in detail with reference to FIGS. 7A to 7C. In an exemplary embodiment, the high voltage may be applied to the T board 200 from another portion of the IP board 100 and may be processed at an external device (for example, the image board and the T-con board 700) of the IP board 100.

In such an embodiment, the lamp 250 is turned on using the high voltage transferred to the T board 200 (S40).

Hereinafter, a structure of an exemplary embodiment of the inverter IC 113 according to the invention will be described.

Figure 7A:
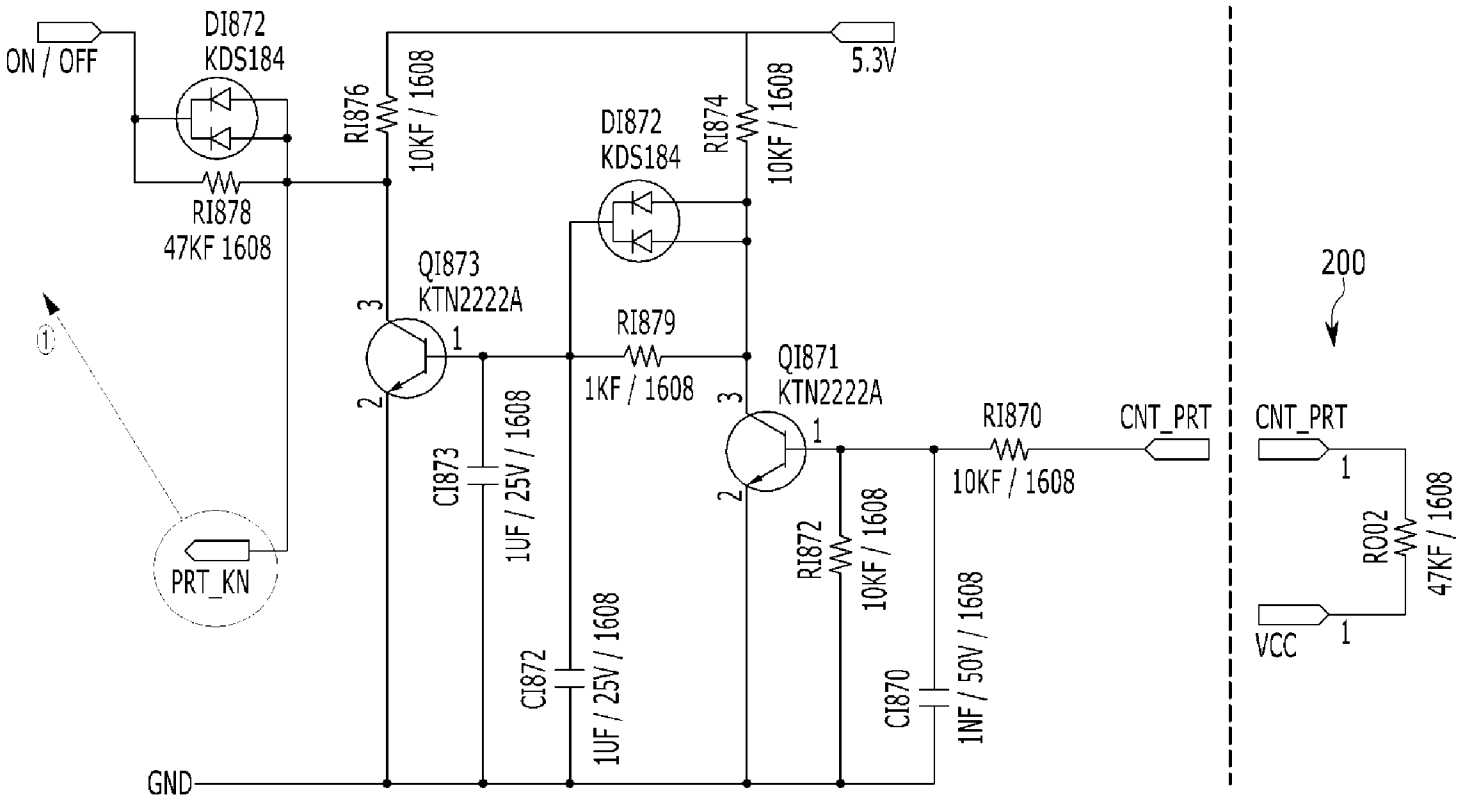
FIGS. 7A to 7C are schematic circuit diagrams showing a circuit structure of an exemplary embodiment of an inverter integrated circuit ("IC") in an IP board according to the invention.
Figure 7B:
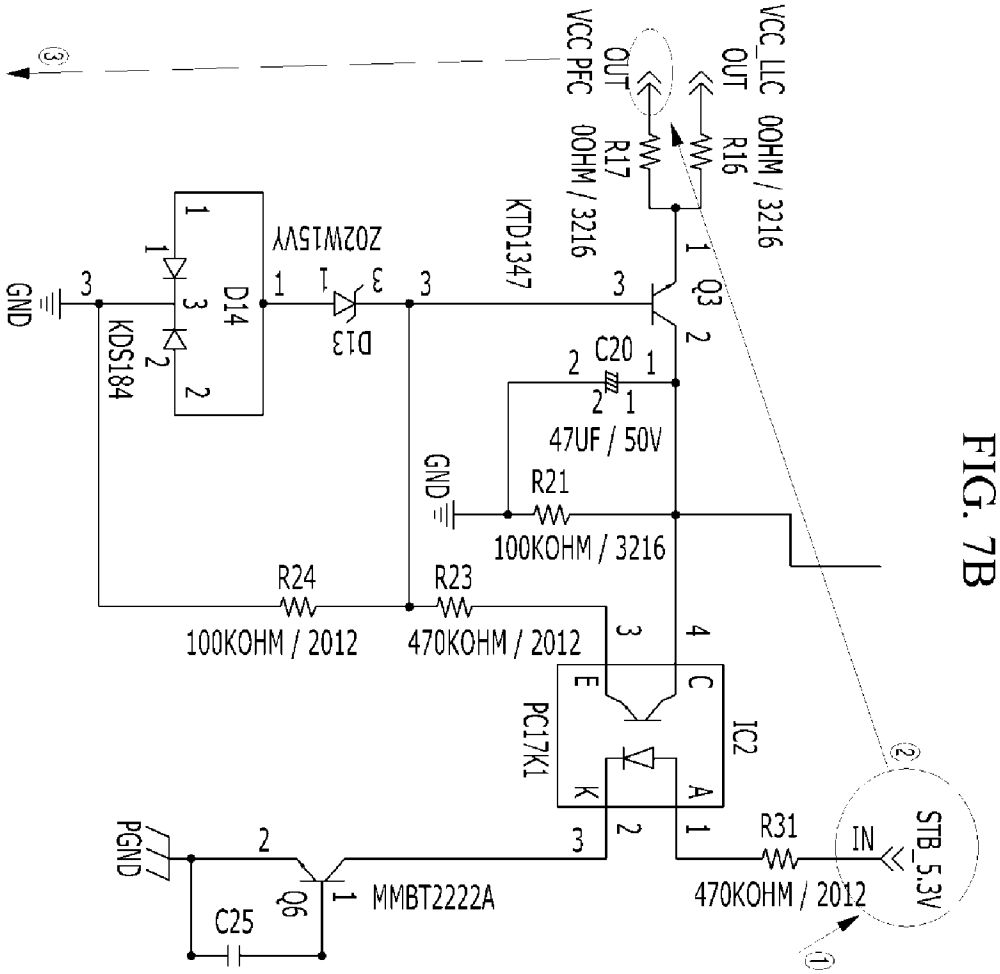
Figure 7C:
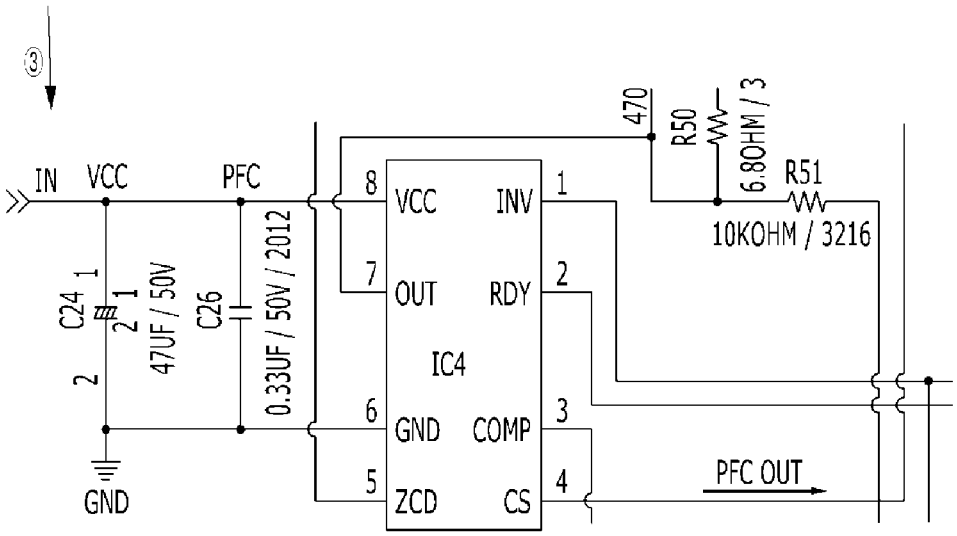

FIGS. 7A to 7C are schematic circuit diagrams showing a circuit structure of an exemplary embodiment of an inverter IC in an IP board according to the invention.

FIGS. 7A to 7C show a circuit structure of an exemplary embodiment of the inverter IC 113 of the IP board 100. In FIG. 7A, the right side of a dotted line schematically shows a partial structure of the T board 200. An exemplary embodiment of the inverter IC 113 is shown in FIGS. 7A to 7C. In FIGS. 7A to 7B, portions of a same exemplary embodiment of the inverter IC 113 are respectively illustrated to exactly show the circuit structure thereof.

Referring to FIG. 7A, a portion of an exemplary embodiment of the T board 200 is schematically shown at the right of the dotted line. The second pad 10 (CNT_PRT) and the first pad 11 (VCC) of the T board 200 may be schematically connected to each other by a resistor. In such an embodiment, when the supply voltage Vcc is inputted to the first pad 11 (VCC), the supply voltage Vcc is inputted to the inverter IC 113 of the IP board 100 through the second pad 10 (CNT_PRT) of the T board 200.

A first portion of the inverter IC 113 is shown in the left side of the dotted line of FIG. 7A. In such an embodiment, when the supply voltage Vcc of about 12 V is inputted from the second pad 10 (CNT_PRT) of the T board 200, a QI871 transistor is turned on and a base terminal of a QI873 transistor is turned off while the voltage drops to the ground. As a result, input voltage of about 5.3 V is applied to a PRT_KN terminal.

In FIG. 7A, an output of the PRT_KN terminal is inputted to a STB__5.3V of FIG. 7B as indicated by arrow 1.

In FIG. 7B, the inputted voltage of about 5.3 V is inputted to the terminal 1 of an IC2 and high voltage is outputted to a VCC PFC OUT terminal by the operation of the IC2. An output of the VCC PFC OUT terminal is inputted to an IN terminal of FIG. 7C as indicate by arrow 3.

In FIG. 7C, the voltage inputted to the IN terminal is inputted to the terminal 8 of an IC4 and the high voltage of about 380 V is transferred to the T board 200 through the terminal 4 of the IC4 by the operation of the IC4 as indicated by PFC OUT arrow.

If the Supply voltage Vcc of about 12 V is not inputted from pad 10 CNT_PRT in FIG. 7A, the QI871 transistor is turned off such that the voltage corresponding to about 5.3 V is applied to the base terminal of the QI873 transistor. The QI873 transistor is turned on by the voltage of 5.3 V and the ground voltage is applied to the PRT_KN terminal such that a subsequent operation does not occur.

In the circuit of FIGS. 7B and 7C, a predetermined time (e.g., about 1.5 seconds to about 1.6 seconds), from the time when the voltage is inputted to the terminal of the STB__5.3V to the time when the high voltage is outputted to the PFC OUT through terminal 4 of the IC4, is delayed. In an exemplary embodiment, the predetermined time may vary. When the predetermined time is shorter than about 0.5 second, after the worker connects the connector 201, the worker has little time to move a substantial distance from the connector 201 to be less influenced by the high voltage and when the predetermined time is more than about 6 seconds, an unnecessary time delay occurs until the lamp 250 is turned on. In an exemplary embodiment, the predetermined time being delayed is in a range from about 0.5 second to about 6 seconds.

The high voltage is transferred to the T board 200 while the connector 201 is stably connected due to the delay such that the risk of electric shock by the high voltage is substantially reduced.

FIGS. 7A to 7C show the circuit structure of one exemplary embodiment of the inverter IC 113 according to the invention. In an exemplary embodiment, the inverter IC 113 has a structure that transfers the high voltage transferred from the PFC converter 112 to the T board 200. However, when the power supply is inputted, the high voltage is not transferred to the T board 200, and the high voltage is transferred to the T board 200 after the predetermined time (e.g., about 1.5 seconds to about 1.6 seconds) lapses from a time when the supply voltage Vcc transferred from the T board 200 is received. In an exemplary embodiment, the inverter IC may have various circuit structures to operate the process described above.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A light unit, comprising:

an integrated power board which receives power supply and converts the power supply into a high voltage and a supply voltage;

a lamp; and a terminal board which receives the high voltage from the integrated power board to turn on the lamp, receives the supply voltage from the integrated power board to transfer the supply voltage to the integrated power board, wherein the integrated power board transfers the high voltage to the terminal board after the integrated power board receives the supply voltage from the terminal board.

2. The light unit of claim 1, wherein the integrated power board and the terminal board are connected to each other by a connector.

3. The light unit of claim 2, wherein the integrated power board comprises:

a power-factor-correction converter which generates the supply voltage and the high voltage based on a voltage of the power supply; and an inverter integrated circuit which transmits and receives the supply voltage to and from the terminal board, and transfers the high voltage to the terminal board.

4. The light unit of claim 3, wherein the terminal board comprises:

a first pad which receives the supply voltage; and a second pad which transfers the supply voltage to the integrated power board.

5. The light unit of claim 4, wherein the terminal board further comprises:

a third pad and a fourth pad which receive the high voltage; a fifth pad which receives ground voltage, and a sixth pad and a seventh pad which receive a signal for verifying a state of the lamp.

6. The light unit of claim 4, wherein the inverter integrated circuit comprises a transistor, and the inverter integrated circuit transfers the high voltage to the terminal board after a predetermined time lapses from a time when the transistor is turned on by the supply voltage transferred from the second pad of the terminal board.

7. The light unit of claim 6, wherein the predetermined time is in a range from about 0.5 second to about 6 seconds.

8. The light unit of claim 7, wherein the predetermined time is in a range from about 1.5 seconds to about 1.6 seconds.

9. The light unit of claim 1, further comprising:

at least one of an image board and a timing controller board, wherein the light unit is a backlight unit for a liquid crystal display.

10. A driving method of a light unit, comprising:

applying a supply voltage from an integrated power board to a terminal board;

transferring the supply voltage from the terminal board to the integrated power board;

applying a high voltage to the terminal board after a predetermined time elapses from a time when the integrated power board receives the supply voltage from the terminal board; and turning on a lamp using the high voltage from the terminal board.

11. The method of claim 10, wherein the applying the supply voltage from the integrated power board to the terminal board comprises:

applying the supply voltage from the integrated power board to the terminal board via a connector connected to the integrated power board and the terminal board.

12. The method of claim 11, wherein the transferring the supply voltage from the terminal board to the integrated power board comprises:

transferring the supply voltage from the terminal board to the integrated power board via a loop circuit.

13. The method of claim 12, wherein the integrated power board comprises:

a power-factor-correction converter which generates the supply voltage and the high voltage based on a voltage of power supply inputted thereto; and an inverter integrated circuit which transmits and receives the supply voltage to and from the terminal board and transfers the high voltage to the terminal board.

14. The method of claim 13, wherein the terminal board comprises:

a first pad which receives the supply voltage; and a second pad which transfers the supply voltage to the integrated power board.

15. The method of claim 14, wherein the inverter integrate circuit comprises a transistor, and the inverter integrate circuit transfers the high voltage to the terminal board after a predetermined time lapses from a time when the transistor is turned on by the supply voltage transferred from the second pad of the terminal board.

16. The method of claim 15, wherein the predetermined time is in a range from about 0.5 second to about 6 seconds.

17. The method of claim 16, wherein the predetermined time is in a range form about 1.5 second to about 1.6 seconds.

18. The method of claim 10, wherein the light unit comprises at least one of an image board and a timing controller board, and the light unit is a backlight unit for a liquid crystal display.

* * * * *